United States Patent [19]

Kong

[11] 4,364,492

[45] Dec. 21, 1982

[54] EASY-DISPENSING SAFETY CAP

[76] Inventor: Cheung T. Kong, 192H Casuda Canyon, Monterey Park, Calif. 91754

[21] Appl. No.: 236,661

[22] Filed: Feb. 23, 1981

Related U.S. Application Data

[63] Continuation-in-part of Ser. No. 136,430, Apr. 2, 1980, abandoned.

[51] Int. Cl.[3] ..... B67D 5/06

[52] U.S. Cl. ..... 222/205; 222/207; 222/450; 222/452; 222/519; 222/522; 222/158

[58] Field of Search ..... 222/158, 205, 207, 425, 222/450, 453, 454, 455, 435, 486, 492, 499, 519, 522, 524, 451, 452

[56] References Cited

U.S. PATENT DOCUMENTS

| | | | |
|---|---|---|---|
| 1,914,766 | 6/1933 | Zaloschan | 222/452 |
| 2,877,918 | 3/1959 | Gardner | 222/522 |
| 3,067,916 | 12/1962 | Lerner | 222/519 |
| 4,077,547 | 3/1978 | Donoghue | 222/207 |

FOREIGN PATENT DOCUMENTS

| | | | |
|---|---|---|---|
| 359449 | 5/1982 | Italy | 222/455 |

*Primary Examiner*—H. Grant Skaggs
*Attorney, Agent, or Firm*—Christie, Parker & Hale

[57] ABSTRACT

An easy-dispensing safety cap for selectively providing difficulty or ease in dispensing liquid from a flexible wall container is disclosed. The easy-dispensing safety cap comprises two nested cylindrical configurations: an inner cap and an outer cap. The inner cap has an outer annular wall and an inner annular wall spaced from the outer annular wall and joined to the outer annular wall by a bottom. A planar surface extends across and joins the inner annular wall defining a downwardly opening cavity. The downwardly opening cavity can be fitted over a neck of a flexible wall container. A conduit extends through the planar surface for permitting liquid flow between the downwardly opening cavity and a measuring chamber defined by the outer annular wall. A disk having an opening is fitted within the conduit. A lip having a notch thereon extends around and projects outwardly from the annular wall. The inner cap is nested within the outer cap. The outer cap comprises a cylindrical figure having a sidewall. A top extends across and joins the sidewall forming a downwardly opening cavity. At least one opening is provided through the sidewall. A projection having a channel therealong is attached to the top and extends downwardly into the cavity and into the conduit engaging the disk for selectively plugging or opening the conduit to fluid flow. A detent is on the inner surface of the sidewall. The detent catches on or engages the lip on the inner cap for preventing the outer cap from being lifted off the inner cap. The outer cap can rotate about the inner cap and can slide up or down until the detent on the sidewall catches the lip on the inner cap.

9 Claims, 4 Drawing Figures

EASY-DISPENSING SAFETY CAP

CROSS-REFERENCE TO RELATED APPLICATION

This application is a continuation-in-part of copending patent application Ser. No. 136,430, filed Apr. 2, 1980, and titled CONVERTIBLE PRECAUTIONARY AND EASY-DISPENSING CAP FOR LIQUID CONTAINER, which is incorporated herein by this reference and now abandoned.

BACKGROUND OF THE INVENTION

This invention relates to an easy-dispensing safety cap for liquid containers. In particular, this invention relates to an easy-dispensing safety cap which can provide a measured amount of liquid from the container on which it is placed.

A precautionary arrangement for a cap is characterized by a locking of the cap on a container such that a complex manipulation is required to remove the cap from the container or to be able to dispense material from the container. By making it necessary to perform such a complex manipulation in order to remove the cap from the container or the material from the container, an advantage arises with respect to preventing children from gaining access to the contents of the container. For example, the contents of the container can be medicines, poisons, caustics, acids and the like, which can be injurious to children of tender years. Children of tender years can often gain possession of containers containing such harmful materials even though the containers are generally secured in areas difficult for children to reach.

Although such precautionary arrangements for containers are advantageous in circumstances where a need for safety exists, it can constitute a nuisance in other circumstances. For example, many elderly people never have small children in their homes. Moreover, such older people may be lacking in manual dexterity and, accordingly, may find it difficult and sometimes impossible to perform the difficult manipulations needed to remove a cap from a container so that they might utilize the material contained therein. For example, many people find it difficult to open the so-called "child-proof" containers containing medicine.

It would, therefore, be desirable to provide a cap for a liquid container which would permit easy dispensing of the liquid contained in the container while selectively making it difficult for the liquid contents to be dispensed.

SUMMARY OF THE INVENTION

The present invention is directed to an easy-dispensing safety cap for selectively providing difficulty or ease in dispensing a liquid from a container. In operation, the invention can best be defined in combination with a flexible wall container. The easy-dispensing safety cap comprises two nested cylindrical configurations: an inner measuring cap for measuring the liquid to be dispensed, and an outer cap.

The inner measuring cap has a generally cylindrical configuration with one open end. The inner measuring cap comprises an outer annular wall and an inner annular wall spaced from the outer annular wall and defining an upwardly opening measuring chamber within the outer annular wall. A planar surface extends across and perpendicular to the inner annular wall to form a downwardly opening cavity within the inner annular wall.

The downwardly opening cavity engages the flexible wall container from which liquid is to be dispensed. A conduit extends through the planar surface for permitting fluid flow between the downwardly opening cavity and the measuring chamber. Within the conduit is a disk which can channel flow of liquid through the conduit. A lip extends outwardly from the outer annular wall and encircles the inner measuring cap.

The outer cylindrical figure of the nested arrangement comprises an outer cap having a sidewall with at least one opening extending through the sidewall. A top extends between the sidewall enclosing and forming a downwardly opening cavity into which the inner measuring cap is nested. The inner measuring cap freely rotates within such cavity. Protrusions are provided on the inside of the sidewall as stopping means for engaging the lip on the outer annular wall of the inner measuring cap. Such protrusions prevent the inner measuring cap from sliding out of the cavity. Thus, the extent of movement of the inner measuring cap is between the protrusions and the top of the outer cap. A projection extends downwardly from the top of the outer cap. The projection is positioned such that the projection engages the conduit extending through the planar surface of the inner measuring cap and the disk within the conduit. The cross-sectional configuration of the projection is such that when it engages the conduit, it selectively can effectively close the conduit for preventing the flow of liquid through the conduit or upon rotation of the outer cap can permit liquid flow through the conduit.

The foregoing and other objects, features and advantages of the present invention will become more apparent in light of the following detailed description of preferred embodiments thereof, as illustrated in the accompanying drawings.

DETAILED DESCRIPTION

Figure 1:
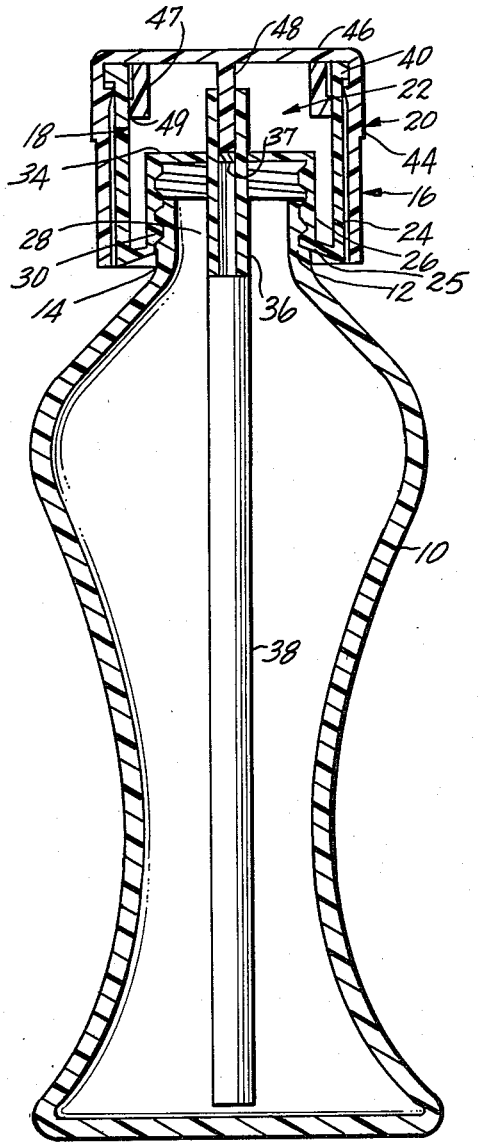
FIG. 1 is a sectioned elevational view of a container for liquids with an embodiment of an easy-dispensing cap for selectively providing difficulty or ease in dispensing a liquid.

Referring to the drawings, wherein like numerals refer to like components, FIG. 1 shows a flexible wall container 10 having a flexible wall terminating in a neck 12. The neck 12 of the flexible wall container is threaded for engaging a threaded closing means for the container. For example, the threaded closing means can be a threaded cap (not shown). Many containers for liquids are currently available with threaded caps. Such threaded caps are easily and readily removed by merely twisting the cap from the neck of the container.

Figure 2:
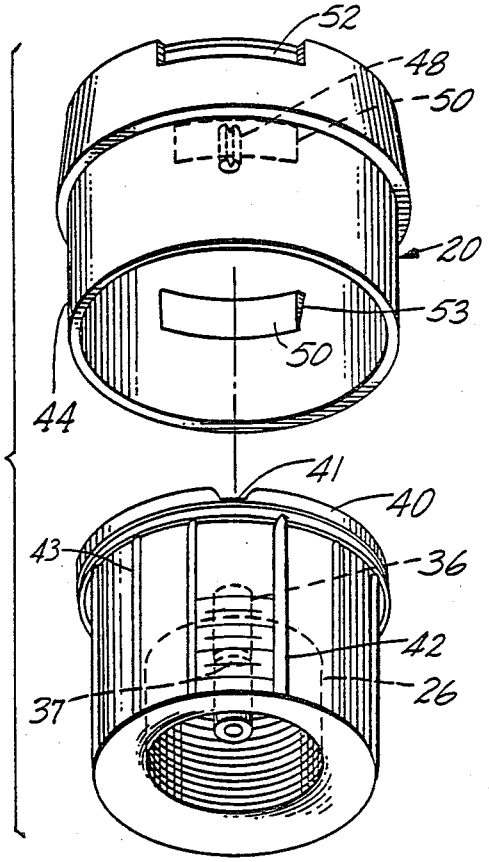
FIG. 2 is an exploded, perspective view of another embodiment of an easy-dispensing safety cap.

In accordance with the presently preferred embodiment, there is provided on the flexible wall container 10 an easy-dispensing safety cap 16. The precautionary cap 16 is also shown in FIG. 2 and comprises two nested cylindrical configurations. The first cylindrical configuration is an inner measuring cap 18 nested within the second cylindrical configuration. The second cylindrical configuration is an outer cap 20.

The inner cylindrical configuration of the nested arrangement is an inner measuring cap for measuring the liquid to be dispensed from the flexible wall container 10. The inner measuring cap comprises a generally cylindrical figure with one open end. The inner measuring cap has an outer annular wall 24 which surrounds and defines an upwardly opening measuring chamber 22. The inner measuring cap 18 also has an inner annular wall 26 spaced from the outer annular wall 24. The measuring chamber 22 has a bottom 25 joining the inner annular wall 26 and outer annular wall 24. The outer annular wall 24, bottom 25 and inner annular wall 26 define the upwardly opening measuring chamber 22.

The inner annular wall 26 has a planar surface 34 extending across and joining the inner annular wall. The inner annular wall 26 has a height less than the height of the outer annular wall 24. The height of the inner annular wall 26 is relative to the height of the outer annular wall 24. The height of both the inner and the outer annular walls can vary and, as the heights vary, the volume of the measuring chamber 22 can also vary. The distance between the inner and outer walls can also vary to vary the volume of the measuring chamber 22.

The planar surface 34 and inner annular wall 26 define a downwardly opening cavity 28. The downwardly opening cavity 28 provides the means for attachment of the precautionary cap 16 to the neck 12 of the flexible wall container 10. That is, the neck of the flexible wall container fits into the downwardly opening cavity engaging the attachment means within the downwardly opening cavity such as shown in FIG. 1. The threads 14 in the container engage corresponding threads 30 along the inner annular wall 26 within the downwardly opening cavity 28.

The pitch of the threads 14 and the diameter of the cavity 28 can be varied to fit the container on which the precautionary cap is to be placed. Similarly, the height of the annular wall and corresponding depth of the cavity 28 can be varied to fit the neck of the container.

A conduit 36 extends through the planar surface 34. The conduit 36 provides a means for fluid communication between the downwardly opening cavity 28 and the measuring chamber 22. the conduit 36 extends above and below the planar surface 34. The portion of the conduit 36 extending below the planar surface can be provided with a flexible conduit 38 which extends into the flexible wall container. Such a flexible conduit 38 provides the means for transferring liquid in the flexible wall container to the measuring chamber through the conduit 36.

Figure 3:
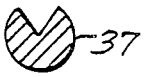
FIG. 3 is a top view of one embodiment of a disk.

A disk 37 lies within the conduit 36. The disk is a solid disk having a configuration which channels liquid flow through the conduit. The disk can have many geometric configurations. One embodiment of the disk is illustrated in FIG. 3. In FIG. 3 the disk 37 is a circular solid having a wedge section providing the means for channeling of the liquid flow. Instead of a wedge-shaped opening, the disk 37 can have an off-center circular opening or a double-wedge opening (i.e., resembling a beer can top). Other openings are also utile.

The outer annular wall of the inner measuring cap has an outwardly extending lip 40. The outwardly extending lip 40 projects outwardly from the outer annular wall 24. A notch 41 (shown in FIG. 2) is provided along the outer annular wall 24 and in the extending lip 40. The notch 41 provides for dispensing or pouring of liquid from the measuring chamber 22.

The second cylindrical figure of the nested cylindrical configuration of the precautionary cap 16 comprises an outer cap 20. The outer cap 20 has a generally cylindrical configuration formed by a sidewall 44. The sidewall 44 has at least one opening 52 extending therethrough as is shown in FIG. 2. The legnth of the sidewall 44 is about the length of the outer annular wall 24 of the inner measuring cap 18. The outer cap 20 has a top 46 extending across the sidewall 44. The top and sidewall form a downwardly opening cavity into which is nested the inner measuring cap 18.

The inner measuring cap has a sufficiently small diameter such that the inner measuring cap slides into the cavity formed by the sidewall 44 of the outer cap 20. Preferably, the inside diameter of the outer cap 20 equals the outside diameter of the outer annular wall 24 as measured across the inner measuring cap 18 at the lip 40. That is, the lip 40 around the inner measuring cap slides along the inner surface of the sidewall 44.

The outer cap is free to rotate about the inner measuring cap and can be free to move up and down (vertically) over the inner measuring cap. The degree of difficulty of sliding the outer cap 20 upwardly along the inner measuring cap 18 is sufficient such that a child of tender years would have difficulty in pulling the outer cap upwardly.

Along the inner surface of the sidewall 44 is at lease one catch or detent 50. Such catches 50 engage the outwardly extending lip 40 for stopping and preventing the outer cap from sliding completely off the inner measuring cap 18. The outwardly extending lip 40 engages the catches 50 preventing further sliding of the outer cap. In this manner, the flexible wall container 10 is made somewhat "child-proof" as the outer cap is not removable. The catch 50 can be positioned lower on the inner surface of the sidewall 44 than is shown in FIG. 1, for example, as is shown in FIG. 2. Positioning the catch 50 lower on the sidewall permits the outer cap 20 to slide up and down over the inner measuring cap 18 but without being removable. By raising the outer cap the inner cap is exposed permitting it to be grasped by the fingers for unscrewing and removal from the container.

The outer cap 20 can include an inner wall 47 which extends from the top 46. The inner wall 47 is spaced apart from the sidewall 44 forming an annulus therebetween. The distance between the inner wall and sidewall is sufficient for receiving the outer annular wall 24 of the inner measuring cap 18. The outer annular wall 24 slides into the annulus forming an effective liquid seal to prevent liquid from flowing out of the measuring chamber 22 and over the outer annular wall 24. The inner wall 47 can be a straight wall or can have a rim 49 which engages the outer annular wall 24. In some embodiments of the safety cap herein, an effective liquid seal can be formed without the need for such an inner annular wall.

Figure 4:
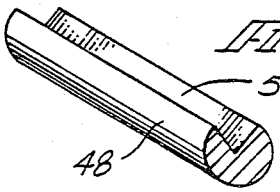
FIG. 4 is a perspective view of one embodiment of a projection.
Figure 2:
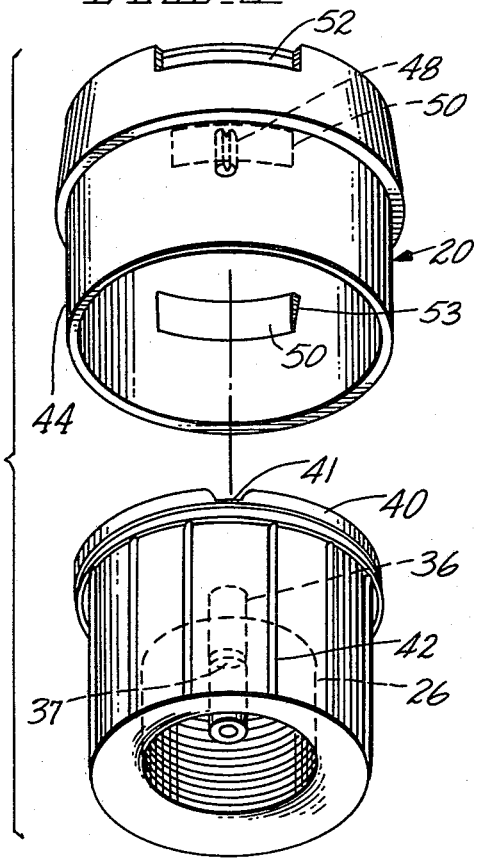
Figure 3:
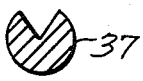
Figure 4:
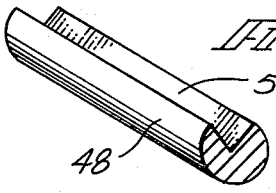

The outer cap 20 has a projection 48 extending into the cavity formed by the sidewall 44. The projection 48 is preferably centered along the top 46. The projection 48 is positioned such that the projection engages the conduit 36. The projection 48 fully engages the conduit 36 and can be positioned to prevent the flow of liquid through the conduit. The projection has a slot or channel 51 along its side which permits fluid flow through the conduit 36 even though the projection 48 is within the conduit. Such a channel 51 in the projection is shown in FIG. 4. The channel can be of any geometric shape, such as for the embodiment herein which is wedge shaped to conform to the shape of the notch 41 in the disk 37 within the conduit. Fluid flow through the conduit can be selectively permitted or prevented by turning the outer cap which turns the projection to either open or close the notch in the disk or channel in the projection.

As shown in FIG. 2, the catch 50 can be formed by a projection or detent on the inner surface of the sidewall 44. For example, two such projections or detents can be formed opposite each other on the inner surface of the sidewall 44. The mount of projection inwardly of the catch 50 is sufficient for engaging the lip 40. The catch 50 can have an inclined plane cross section as shown in FIGS. 1 and 2. Such a cross section permits the inner measuring cap to slide into the outer cap but prevents the inner measuring cap from sliding out of the outer cap. Preferably, at least one of the catches 50 has a squared-off end 53. The squared-off end can catch on a rib 42 on the outside of the outer annular wall 24 of the inner measuring cap. By catching on such a rib, the turning of the outer cap can also turn the inner measuring cap so as to permit screwing into a suitable container 10. The catch and rib can be relatively positioned to each other so that when the catch engages the rib, fluid flow is permitted through the conduit 36.

With regard to FIG. 2, the inner measuring cap can be provided with additional ribs or knurls 43. Such knurls 43 can extend along the length of the outer annular wall 24 but project outwardly at a lesser height than the rib 42. The knurls can facilitate unscrewing the inner measuring cap 18 from the neck of a flexible wall container. When the outer cap 20 is pushed down such that the top 46 of the outer cap touches the top of the inner measuring cap, the inner measuring cap and knurls 43 are unexposed. When the outer cap is slid upwardly such that the catch 50 engages the lip 40, the knurls 43 on the outer surface of the outer annular wall are exposed to facilitate the placement or removal of the precautionary cap 16 on a flexible wall container.

In operation, the precautionary cap 16 is fitted with a flexible tubing 38 and placed over the neck of a flexible wall container such that the downwardly opening cavity defined by the inner annular wall fits over and engages the neck of the flexible wall container. The outer cap is rotated in a clockwise fashion causing the catch 50 to catch on the rib 42. As the outer cap is continuously rotated, the inner measuring cap also rotates threading the inner measuring cap onto the neck of the flexible wall container. The outer cap can then be rotated counterclockwise to close the conduit 36 effectively preventing liquid from flowing through the conduit.

To dispense liquid from the flexible wall container having a precautionary cap 16 as described, the outer cap is turned until the catch 50 engages the rib 42. In this position the channel in the projection 48 is aligned with the slot in the disk 37 to permit liquid to flow through the conduit 36. As the flexible wall container 10 is squeezed, pressure in the container forces the liquid therein to flow through the flexible tube 38 and through the conduit 36. The liquid flows out of the conduit 36 and into the measuring chamber 22. The outer annular wall 24 of the inner measuring cap or the sidewall 44 of the outer cap can be graduated to provide a means for measuring the liquid dispensed from the container. Thus, the flexible wall container can be squeezed until the desired amount of liquid has been dispensed and collected in the measuring chamber 22. When the desired amount of liquid has been transferred to the measuring chamber, the outer cap can be rotated to align the opening 52 in the outer cap with the notch 41 of the inner measuring cap such that the liquid in the measuring chamber can flow out of the measuring chamber through the notch 41 and opening 52.

The opening 52 in the sidewall 44 can be at any convenient location on the sidewall. The size of the opening 52 can also be varied. In an alternative embodiment of a precautionary dispensing cap the opening 52 in the sidewall 44 of the outer cap is not aligned with the notch 41 in the inner measuring cap when the outer cap is pushed down against the inner measuring cap such that their tops coincide. Two movements of the cap assembly is required to dispense liquid from a flexible wall container having such an alternate precautionary dispensing cap. First, the outer cap is raised such that the catches 50 strike and engage the lip 42 on the inner measuring cap. The notch 41 and the opening through the sidewall of the outer cap are relatively positioned within a horizontal plane. The outer cap is then rotated to align the opening with the notch 41 to permit liquid to flow from the measuring chamber through the opening.

The precautionary cap has a precautionary arrangement as the outer cap can spin counterclockwise about the inner measuring cap. Such spinning of the outer cap does not unscrew the inner measuring cap from the neck of the flexible wall container. In addition, the mere spinning of the outer cap does not permit the dispensing of liquid from the flexible wall container.

The alternative embodiment provides additional precautionary arrangement to the precautionary dispensing cap as children of tender years would not be expected to pull up on the outer cap and carefully align the opening in the outer cap with the notch in the inner measuring cap. Most children would be expected to merely spin the outer cap about the inner measuring cap. Such rotating of the outer cap does not remove the inner measuring cap from the flexible wall container. To remove the precautionary cap from the container, the outer cap can be raised to expose knurls on the outer surface of the annular wall of the inner dispensing cap. By grasping the knurls of the inner measuring cap it can be unscrewed from the neck of a flexible wall container.

It will be appreciated by those skilled in the art that various modifications of the specifically described presently preferred embodiments are within the scope of the present invention. For example, the sizes of the elements of the precautionary caps herein described can be varied to fit differing flexible wall containers. In addition, other means for securing the precautionary cap to the flexible wall container can be provided other than the threads disclosed in the presently preferred embodiments. In addition, the tightness of the outer cap with regard to the inner cap in all of the embodiments can be varied to provide ease or difficulty in pulling the outer cap upwardly. For example, the tightness can be varied by changing the number of lips around the outer annular wall of the inner cylindrical cap or by changing the surface area of contact between the outer cap and the inner cylindrical cap. As the precautionary caps herein are not easily removed from a container, it will be appreciated that the caps can also be placed on containers containing substances other than liquids, e.g., pills and powder sets.

Thus, it should be understood by those skilled in the art that various changes and omissions in form and detail in the specific preferred embodiments described herein can be made without departing from the spirit and scope of the invention, which is to be limited only as set forth in the following claims.

What is claimed is:

1. An easy-dispensing safety cap for selectively providing difficulty or ease in dispensing a liquid from a container comprising:

(a) an inner measuring means for measuring liquid to be dispensed from a container, the inner measuring means comprising a generally cylindrical configuration with one open end, an outer annular wall and an inner annular wall spaced from the outer annular wall and joined to the other annular wall by a bottom to define an upwardly opening measuring chamber within the outer annular wall, a planar surface extending across the inner annular wall to form a downwardly opening cavity within the inner annular wall which downwardly opening cavity provides means for engaging a container from which liquid is dispensed, a conduit extending through the planar surface for permitting fluid flow between the downwardly opening cavity and measuring chamber, means within the conduit for selectively permitting or preventing fluid flow therethrough and an outwardly extending lip on the outer annular wall having a notch therein; and (b) an outer cap comprising a generally cylindrical configuration formed by a sidewall with at least one opening extending through the sidewall, a top extending between the sidewall forming a downwardly opening cavity for receiving the inner measuring means such that the inner measuring means can slide within the cavity, stopping means positioned along the sidewall for engaging the lip on the outer annular wall of the inner measuring means and for preventing the inner measuring means from sliding out of the downwardly opening cavity, the inner measuring means being freely slidable between the stopping means and top, and a projection having a channel for fluid flow therealong extending downwardly from the top such that the projection engages the means within the conduit for permitting or preventing fluid flow through the conduit effectively closing or opening the conduit to fluid flow when the outer cap is rotated about the inner measuring means.

2. An easy-dispensing safety cap as recited in claim 1 wherein such opening through the sidewall of the outer cap aligns with the notch on the lip of the outer annular wall when the outer cap is pulled upwardly.

3. An easy-dispensing safety cap as recited in claim 1 wherein such opening through the sidewall of the outer cap aligns with the notch on the lip of the outer annular wall when the top of the outer cap engages the inner measuring means.

4. An easy-dispensing safety cap as recited in claim 1 wherein the means for engaging a container in the downwardly opening cavity comprises threads for engaging threads on a flexible wall container.

5. An easy-dispensing safety cap as recited in claim 4 wherein the inner measuring means has knurls for screwing the easy-dispensing safety cap onto a flexible wall container.

6. An easy-dispensing safety cap as recited in claim 1 wherein the stopping means on the sidewall of the outer cap comprises at least one projection on the sidewall projecting inwardly of the outer cap.

7. An easy-dispensing safety cap as recited in claim 6 wherein such projection has one squared end.

8. An easy-dispensing safety cap as recited in claim 7 wherein the inner measuring means has at least one rib thereon which engages the squared end of the projection for aligning the outer cap on the inner measuring means to permit fluid flow through the conduit.

9. An easy-dispensing safety cap as recited in claim 1 further comprising an inner wall extending from the top of the outer cap and spaced from the sidewall thereof and forming an annulus into which the outer annular wall of the inner measuring means slides.

* * * * *

UNITED STATES PATENT AND TRADEMARK OFFICE

CERTIFICATE OF CORRECTION

PATENT NO. : 4,364,492

DATED : December 21, 1982

INVENTOR(S) : Cheung Tung Kong

It is certified that error appears in the above-identified patent and that said Letters Patent is hereby corrected as shown below:

In the drawings, Sheet 3 should be eliminated as it is an incorrect drawing of Sheet 2. Column 3, line 44, before "conduit" change "the" to -- The --. Column 4, line 6, change "legnth" to -- length --. Column 6, line 5, change "41 of" to -- 41 on --. Column 7, line 16, change "other" to --outer --.

Signed and Sealed this

*Seventeenth* Day of *May 1983*

[SEAL]

*Attest:*

DONALD J. QUIGG

*Attesting Officer* *Acting Commissioner of Patents and Trademarks*